United States Patent [19]

Stiller

[11] 4,019,092

[45] Apr. 19, 1977

[54] PHOTOGRAPHIC FLASH APPARATUS

[75] Inventor: Armin Stiller, Braunschweig, Germany

[73] Assignee: Rollei-Werke Franke & Heidecke, Braunschweig, Germany

[22] Filed: Apr. 18, 1975

[21] Appl. No.: 569,582

[30] Foreign Application Priority Data

May 15, 1974 Germany ..... 2423527

[52] U.S. Cl. ..... 315/159; 315/241 P

[51] Int. Cl.[2] ..... H05B 41/32; H05B 37/02; H05B 37/00

[58] Field of Search ..... 315/151, 159

[56] References Cited

UNITED STATES PATENTS

| | | | |
|---|---|---|---|
| 3,716,753 | 2/1973 | Exner | 315/159 X |
| 3,774,072 | 11/1973 | Ogawa | 315/151 |
| 3,864,601 | 2/1975 | Schneider | 315/151 |
| 3,869,642 | 3/1975 | Sabanci | 315/151 |

*Primary Examiner*—Robert Segal
*Attorney, Agent, or Firm*—Stonebraker, Shepard & Stephens

[57] ABSTRACT

Electronic flash apparatus of the general type having exposure-measuring and flash-limiting mechanism comprising a light-sensitive element connected in series with an integrating capacitor and a thyristor, arranged so that when the thyristor becomes conductive, it causes a pulse which interrupts or terminates the flash. In distinction from prior flash apparatus of this same general type, the present apparatus has circuitry in which one plate of the integrating capacitor is connected to the collector of a photo-transistor and the other plate is connected to the control grid of the thyristor and to a higher voltage source, while the emitter of the photo-transistor is connected to a lower voltage source. Other circuit details are disclosed, resulting in a flash unit which is less trouble-prone and easier to adjust than prior flash units of the same general type, and which compensates for the close-up effect so that pictures taken at close range are not over-exposed, as happens so often with many of the prior art flash units.

4 Claims, 2 Drawing Figures

PHOTOGRAPHIC FLASH APPARATUS

BACKGROUND OF THE INVENTION

The invention relates to electronic flash apparatus for photographic purposes, having an exposure-measuring and flash-limiting device which comprises a light-sensitive element connected in series with an integrating capacitor and a thyristor which, when it becomes conductive, causes a pulse which effects the interruption or termination of the flash. Photographic flash apparatus of this general type, having the features just mentioned, is well known in the art.

In one of the known forms of this general type of flash apparatus, a series connection of a photo-transistor and an integrating capacitor is connected between the plus and minus poles of the voltage source of the exposure-measuring and flash-limiting device or mechanism. The control electrode of the thyristor is connected to the point of connection between the emitter of the photo-transistor and the integrating capacitor, and the cathode of the thyristor is connected with the adjustable resistor of a voltage divider. When a specific capacitor voltage is reached, the thyristor is ignited (i.e., becomes conductive) and the flash discharge is broken off or terminated in known manner. The ignition threshold of the thyristor can be adjusted by the variable resistor connected to its cathode.

In this known form of device just mentioned, it is found that the electronic flash apparatus switches off (i.e., the flash is terminated) with considerable time delay when it is used in the close-up range, that is, in the case of a relatively short distance between the flash apparatus and the subject being photographed, so that the photographic images are always over-exposed. Therefore it has been proposed to improve this situation by connecting the cathode of the thyristor both to the center cap of a voltage divider circuit which is energized only during discharge of the flash tube, and also through a capacitor to a lower potential point of this voltage divider circuit. In this way, the cathode potential of the thyristor increases in time-dependence in a predetermined manner in a short time range after ignition of the flash tube, whereby the threshold voltage of the capacitor necessary for the ignition or firing of the thyristor is reduced in this short time range. The ignition pulse of the interruption or termination of the flash thus takes place slightly earlier than is required by the quantity of light measured by the photo-transistor, and this in turn compensates for the over-exposure which would otherwise occur when making close-up pictures.

Although this arrangement just described was apparently a step in the right direction, experience has nevertheless shown that this arrangement has the effect of making the adjustment of the exposure-measuring and flash-limiting mechanism more difficult. Moreover, the apparatus becomes more trouble-prone, so that careful attention must be given to a mutually screened spatial arrangement of pulse-generating circuits within the apparatus.

The present invention attempts to provide flash apparatus which overcomes these difficulties, and which is less delicate or trouble-prone, and more easily adjusted, as compared with the prior devices of the kind above mentioned, yet still containing the desirable feature of compensating for close-up photographs so that over-exposure does not occur.

SUMMARY OF THE INVENTION

According to the present invention, the problem is solved by connecting the integrating capacitor (which is in series, as usual, with the light-sensitive element) with a higher potential point and connecting the light-sensitive element with a lower potential point of the voltage source which is used to supply the feed voltage to the exposure-measuring and flash-limiting mechanism; and also by connecting the control electrode and cathode path of the thyristor in parallel with the integrating capacitor.

To improve the response sensitivity of the exposure-metering and flash-limiting device in the close-up photographic range, the invention further provides that the exposure-measuring and flash-limiting mechanism is operatively connected at the beginning of the flash discharge to its feed voltage source, and a further capacitor is connected in parallel with the light-sensitive element. In this way it is provided that in the case of a very short time between the switching on of the exposure-measuring device and the response of the flash-limiting device (such as occurs in the case of a very short distance between the flash unit and the subject being photographed) the flash-limiting device responds with a certain time lead before reaching the threshold value of the measured light quantity set for optimum exposure, and thus the over-exposure error ordinarily occurring when taking photographs at close range is largely suppressed.

Moreover, according to the invention, a resistor connected in parallel with the integrating capacitor provides for the complete discharge of the integrating capacitor after each flash, thus insuring that the integrating capacitor is free of charge at the beginning of the next flash operation.

In a further development of the invention, to facilitate better adjustment of the exposure-measuring and flash-limiting device, a voltage divider is connected in parallel with the integrating capacitor, and the central path of this divider is connected to the cathode of the thyristor.

DESCRIPTION OF THE PREFERRED EMBODIMENTS

Figure 1:
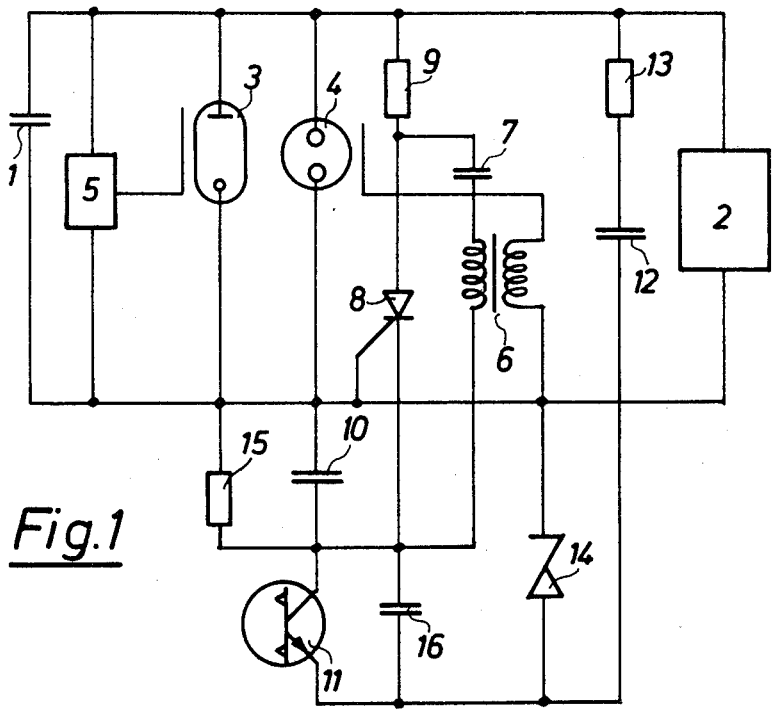
FIG. 1 is a circuit diagram illustrating one form of flash apparatus in accordance with the present invention.

Referring first to the form of the invention shown in FIG. 1, there is a main storage capacitor 1 which is charged up to a working voltage (e.g., 360 volts of direct current) through any suitable source 2, which may be a voltage transformer or converter. In parallel with the storage capacitor 1, there is an electronic flash tube 3, and an electronic switch 4, preferably in the form of a thyratron. The flash tube 3 is ignited or made conductive by a well known ignition device indicated schematically at 5, which device operates in the usual conventional manner, in synchronism with the opening of the shutter of the associated camera with which this flash apparatus is used. The thyraton 4 is ignited (i.e., made condutive) through a conventional ignition electrode which is connected with the secondary winding of a pulse transformer 6, the primary winding of which lies in the discharge circuit of a capacitor 7 which may be called the extinguishing capacitor or quenching capacitor.

The pulse transformer 6 and the quenching capacitor 7 are components of the exposure-measuring and flash-limiting device, and are connected in series with a thyristor 8 which may be called the extinguishing or quenching thyristor. The capacitor 7 can be charged up to the working voltage through resistors 9 and 15. The exposure-measuring device further comprises an integrating capacitor 10 and a photo-transistor 11 which are connected in series with each other and are also connected to the voltage supply or feed voltage of the exposure-measuring and flash-limiting device.

This voltage supply is formed from a capacitor 12 which in series with a resistor 13 and a Zener diode 14. This series circuit of elements 12, 13, 14 is arranged in parallel with the storage capacitor 1 and the flash tube 3. When the flash tube is conductive, the capacitor 12 discharges through the resistor 13, the flash tube 3, and the Zener diode 14, thus providing a constant voltage on the Zener diode 14 for the duration of the discharge of the capacitor 13 and the duration of the flash radiation by the flash tube 3. This constant voltage supplied from the Zener diode forms the feed voltage for the exposure-measuring and flash-limiting device or mechanism.

According to the invention, the integrating capacitor 10 has one plate connected to the upper or higher voltage point of the feed voltage supply, and its other plate is connected to the collector of the photo-transistor 11. Also, the emitter of the photo-transistor 11 is connected to the lower potential point of the voltage supply, that is, to the lower potential side of the Zener diode 14. The cathode of the thyristor 8 is connected to the point of connection between the integrating capacitor 10 and the collector of the photo-transistor 11. The control electrode or gate of the thyristor 8 is connected to the other plate of the integrating capacitor 10, that is, to the plate which is also connected to the higher voltage side of the Zener diode. With this arrangement, the integrating capacitor 10 is connected in parallel with the control electrode-cathode path of the thyristor 8. Also, a resistor 15 is conncted in parallel with the integrating capacitor 10, and a capacitor 16 is connected in parallel with the photo-transistor 11.

The operation of this circuit arrangement illustrated in FIG. 1 and described above is as follows:

When the flash apparatus is in condition ready to flash, the storage capacitor 1 is charged to the normal operating or working voltage (e.g., 360 volts direct current) and the extinguishing capacitor 7 is also charged to the same voltage, through the resistors 9 and 15. The capacitor 12 is charged up through the resistor 13 and Zener diode 14, to the same working voltage.

When the associated camera is triggered or released to take a picture, the ignition device 5 is actuated in the usual conventional manner, and applies an ignition pulse to the ignition electrode of the electronic flash tube 3, so that the tube becomes conductive or ignites. The storage capacitor 1 then discharges through the flash tube 3, thereby creating a brilliant flash of light. At the same time, the capacitor 12 also discharges in the manner described above, to provide a constant operating voltage or feed voltage for the integrating capacitor 10 and photo-transistor 11.

The light flash or flux radiated by the flash tube strikes upon the subject being photographed, is reflected there, and arrives back at the photo-transistor 11. According to the intensity of the light received by the photo-transistor (whether resulting solely from the flash tube 3 or partly from this flash and partly from other sources of illumination) the integrating capacitor 10 is charged up more or less quickly, whereby the cathode potential of the thyristor 8 is reduced in relation to its control electrode or gate potential. When the potential difference reaches the magnitude of the ignition voltage of the thyristor, the thyristor switches through or ignites (i.e., becomes conductive) and the extinguishing or quenching capacitor 7 discharges through the conductive thyristor 8 and the primary winding of the pulse transformer 6. As a result of the current flux through this primary winding of the pulse transformer, a pulse is generated in its secondary winding, which pulse arrives at the ignition electrode of the thyratron 4 and ignites the thyraton, making it conductive. Since the thyratron has a substantially lower burning voltage or resistance than the flash tube, the thyratron takes over the discharge current of the capacitor 1, and consequently the flash tube 3 is extinguished.

The provision of the capacitor 16 in parallel with the photo-transistor 11 serves to improve the response sensitivity of the exposure-measuring and flash-limiting mechanism in the close-up range. At the beginning of the flash discharge from the tube 3, the capacitors 10 and 16 charge up very rapidly, the cathode potential of the extinguishing thyristor 8 being reduced in relation to its control grid or gate potential. The capacitors 10 and 16, acting as capacitative voltage dividers during the time that they are charging, are here dimensioned so that the voltage difference on the capacitor 10 (that is, between the control electrode and the cathode of the thyristor 8) remains less than the ignition voltage of the thyristor.

When the light reflected from the subject strikes upon the photo-transistor 11, the capacitor 10 charges up until the potential difference on its plates exceeds the ignition voltage of the thyristor. Since the capacitor 10 already has a voltage difference between its plates at the moment when the light flux reflected from the subject strikes upon the photo-transistor 11, the lower charging of the integrating capacitor 10, which takes place by the current caused by the photo-transistor as a result of the light flux, is necessary for the ignition of the thyristor 8. Thus the capacitor is charged up to the ignition voltage of the thyristor 8 in a substantially shorter time, so that as a whole the exposure-measuring and flash-limiting device can already respond at a very short time, such as occurs in the case of a short distance from the flash unit to the subject being photographed.

The provision of the resistor 15, in parallel with the integrating capacitor 10, renders possible the discharge of this capacitor after the interruption of the flash discharge, so that at the next operation of the flash apparatus, the capacitor 10 is fully discharged and ready to perform an accurate integrating and measuring function.

Figure 2:
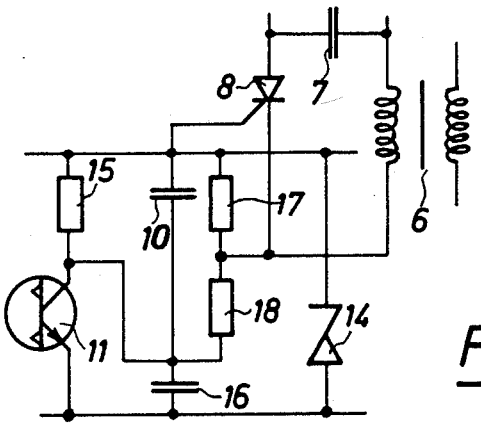
FIG. 2 is a fragmentary circuit diagram, to be read in conjunction with FIG. 1, illustrating a modified and preferred form of the invention.

In the modified arrangement of FIG. 2, a voltage divider circuit comprising the resistors 17 and 18 is connected in parallel with the integrating capacitor 10, as illustrated. The cathode of the extinguishing thyristor 8 is connected to the central tap of this voltage divider 17, 18. The rest of the circuitry, except for this use of the voltage divider 17, 18, is the same as already described in connection with FIG. 1. The operation of this circuit arrangement corresponds to that described in connection with FIG. 1. This modification facilitates the dimensioning of the individual circuit elements, and makes for easier adjustment and less possibility of faulty operation.

What is claimed is:

1. Photographic flash apparatus having an electronic flash tube, means for initiating a flash in said tube, means for terminating a flash in progress in said tube, and exposure-measuring and flash-terminating circuitry for operating said flash terminating means, said circuitry including a light-sensitive element and an integrating capacitor having terminals connected together so said light-sensitive element and said integrating capacitor are in series with each other, a voltage source for said exposure-measuring and flash-terminating circuitry, said voltage source including means for supplying a higher voltage point and a lower voltage point for energizing said exposure-measuring and flash-terminating circuitry, and a thyristor having an anode, a cathode, and a control electrode, said thyristor being effective when conductive to cause said terminating means to terminate a flash, said flash apparatus being characterized by the facts that:

a. a terminal of said integrating capacitor opposite from said terminal connected to said light-sensitive element is connected directly to said higher voltage point;

b. a terminal of said light-sensitive element opposite from said terminal connected to said integrating capacitor is connected directly to said lower voltage point;

c. the control electrode to cathode path of said thyristor is connected in parallel with said integrating capacitor;

d. a resistor is connected in parallel with said integrating capacitor and arranged for discharging said integrating capacitor after each flash and e. means connected between said higher and lower voltage points for maintaining the constancy of the voltage between said points.

2. The flash apparatus of claim 1, further comprising means for actuating said voltage source at the beginning of a flash in said tube to provide said higher voltage point and said lower voltage point, and another capacitor (16) connected in parallel with said light-sensitive element to cooperate with said integrating capacitor in forming a capacitive voltage divider.

3. The flash apparatus of claim 1, further comprising a voltage divider (17,18) connected directly in parallel with said integrating capacitor, and the cathode of said thyristor being connected directly to a center tap of said voltage divider.

4. The flash apparatus of claim 3, further comprising means for actuating said voltage source at the beginning of a flash in said tube to provide said higher voltage point and said lower voltage point, and another capacitor (16) connected in parallel with said light-sensitive element to cooperate with said integrating capacitor in forming a capacitive voltage divider.

* * * * *